US006690767B2

(12) United States Patent
Davis

(10) Patent No.: US 6,690,767 B2
(45) Date of Patent: Feb. 10, 2004

(54) PROTOTILE MOTIF FOR ANTI-SCATTER GRIDS

(75) Inventor: James E. Davis, Wilmington, DE (US)

(73) Assignee: Direct Radiography Corp., Newark, DE (US)

( * ) Notice: Subject to any disclaimer, the term of this patent is extended or adjusted under 35 U.S.C. 154(b) by 0 days.

(21) Appl. No.: 10/079,303

(22) Filed: Feb. 19, 2002

(65) Prior Publication Data

US 2002/0097839 A1 Jul. 25, 2002

Related U.S. Application Data

(63) Continuation-in-part of application No. 09/679,234, filed on Oct. 4, 2000, now Pat. No. 6,366,643, which is a continuation-in-part of application No. 09/181,703, filed on Oct. 29, 1998, now abandoned.

(51) Int. Cl.[7] ..... G21K 1/10
(52) U.S. Cl. ..... 378/154; 378/164
(58) Field of Search ..... 378/154, 164, 378/205

(56) References Cited

U.S. PATENT DOCUMENTS

| | | | | |
|---|---|---|---|---|
| 1,164,987 | A | 12/1915 | Bucky | 378/99 |
| 4,823,370 | A | 4/1989 | Kikuchi | 378/154 |
| 4,875,227 | A | 10/1989 | Rossi et al. | 378/154 |
| 4,951,305 | A | 8/1990 | Moore et al. | 378/147 |
| 5,050,198 | A | 9/1991 | Honda | 378/99 |
| 5,259,016 | A | 11/1993 | Dickerson et al. | 378/186 |
| 5,291,018 | A | 3/1994 | Charpentier | 250/332 |
| 5,606,589 | A | 2/1997 | Pellegrino et al. | 378/154 |
| 5,666,395 | A | 9/1997 | Tsukamoto et al. | 378/98.4 |
| 5,949,850 | A | 9/1999 | Tang | 378/154 |
| 6,157,700 | A | 12/2000 | Sako | 378/98.12 |
| 6,229,877 | B1 | 5/2001 | Agano | 378/154 |
| 6,252,938 | B1 | 6/2001 | Tang | 378/154 |

OTHER PUBLICATIONS

"Precision Fabrication of Two–Dimensional Anti–Scatter Grids," by Cha–Mei Tang, et al.: Medical Imaging 2000: Physics of Medical imaging; Processdings of SPIE vol. 3977 (2000).*

"Precision Fabrication of Two–Dimensional Anti–Scatter Grids," by Cha–Mei Tang, et al.; *Medical Imaging 2000:Physics of Medical Imaging*; Proceedings of SPIE vol. 3977 (2000).

International Search Report dated Nov. 20, 2001, to Application No. PCT/US01/26969.

"The Essential Physics of Medical Imaging," by Jerrold T. Bushberg, Ph.D., J. Anthony Seibert, Ph.D., Edwin M. Leidholdt, Jr., Ph.D., amd John M. Boone, Ph.D. Williams & Wilkins, Baltimore, 1994. pp. 159–168.

* cited by examiner

*Primary Examiner*—David V. Bruce
*Assistant Examiner*—Hoon Song
(74) *Attorney, Agent, or Firm*—Cooper & Dunham LLP; Ivan S. Kavrukov

(57) ABSTRACT

A shielding grid constructed of a radiation absorbing material for use with an array of discreet, non contiguous radiation sensors to protect such sensors from scattered radiation. The sensors each have a radiation sensitive area with a width and a length. In designing the grid a prototile having a prototile width and a prototile length is developed. The prototile width is equal to the radiation sensitive area width divided by an integer and the prototile length is also equal to the radiation sensitive area length divided by an integer. The prototile contains a pinwheel motif of radiation absorbing material contained solely within the prototile that forms a pattern when a plurality of prototiles sufficient to cover the array of discreet sensor are arrayed contiguously. The grid is constructed with the radiation absorbing material in this pattern.

10 Claims, 5 Drawing Sheets

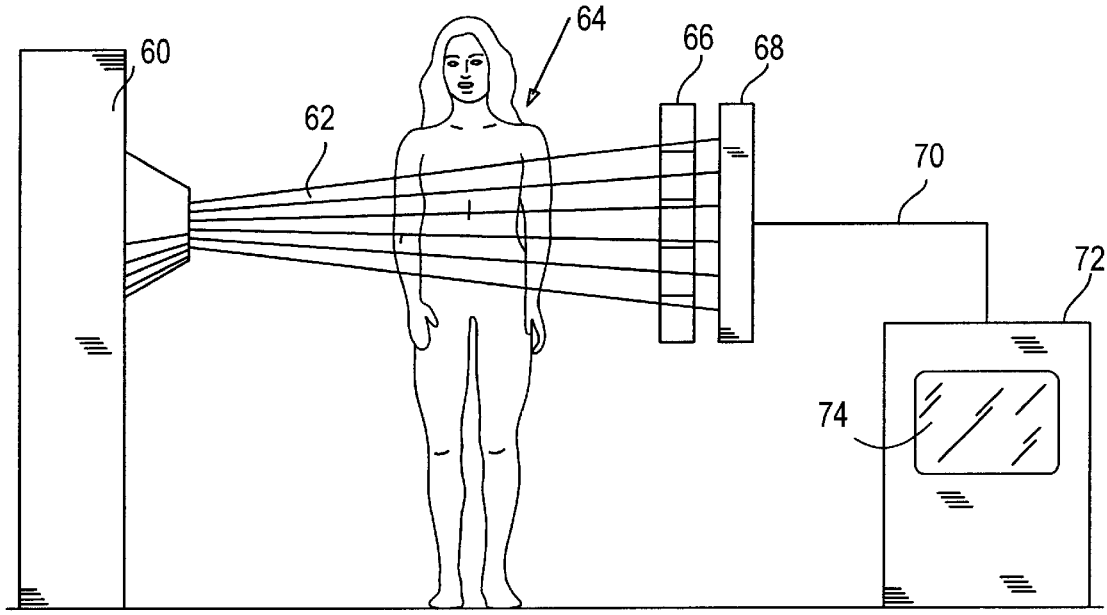
FIG.10
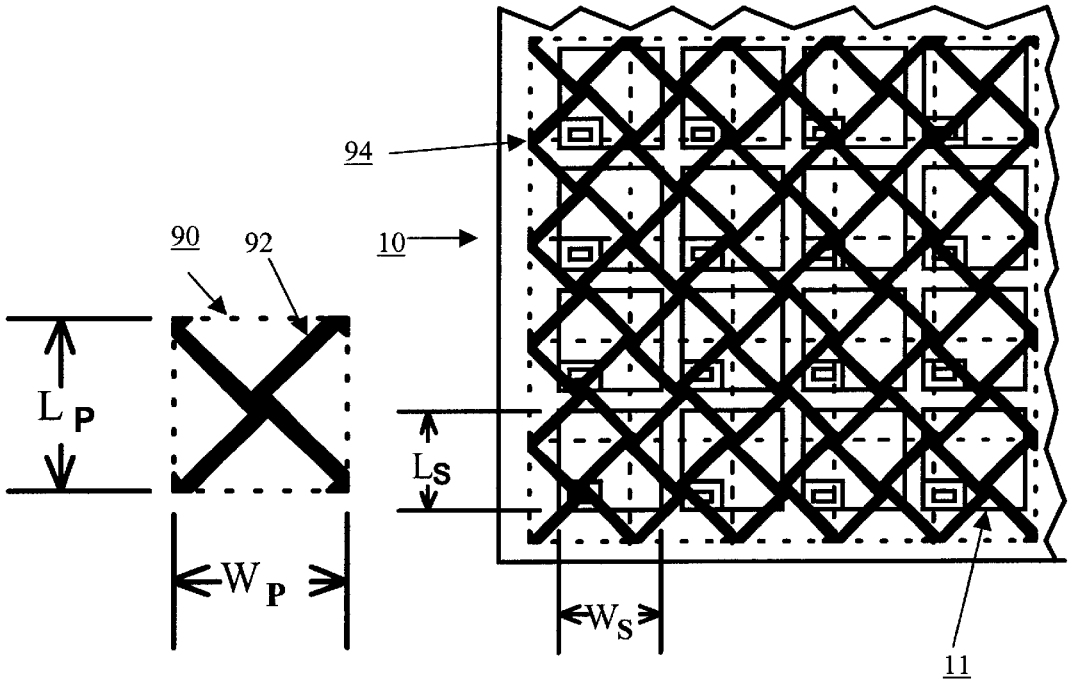
FIG. 11A
FIG. 11

PROTOTILE MOTIF FOR ANTI-SCATTER GRIDS

CROSS REFERENCE TO RELATED APPLICATIONS

This application is a continuation-in-part of application Ser. No. 09/679,234 filed Oct. 4, 2000, issued as U.S. Pat. No. 6,366,643 on Apr. 2, 2002, and which is a continuation-in-part of application Ser. No. 09/181,703 filed Oct. 29, 1998, now abandoned, both of which are incorporated herein by reference.

BACKGROUND OF THE INVENTION

1. Field of the Invention

This invention relates to a radiation shielding grid for use with a radiation detection panel comprising a plurality of spaced discreet radiation sensing elements, and more particularly to a method for designing such a grid to eliminate Moiré patterns and to the resulting grid.

2.Description of Related Art

Direct radiographic imaging using panels comprising a two dimensional array of minute sensors to capture a radiation generated image is well known in the art. The radiation is image-wise modulated as it passes through an object having varying radiation absorption areas. Information representing an image is captured as a charge distribution stored in a plurality of charge storage capacitors in individual sensors arrayed in a two dimensional matrix.

X-ray images are decreased in contrast by X-rays scattered from objects being imaged. Anti-scatter grids have long been used (Gustov Bucky, U.S. Pat. No. 1,164,987 issued 1915) to absorb the scattered X-rays while passing the primary X-rays. Whenever the X-ray detection panel resolution is comparable or higher than the spacing of the grid, an image artifact from the grid may be seen. Bucky also taught moving the anti-scatter grid to eliminate that image artifact by blurring the image of the anti-scatter grid (but not of the object, of course). The anti-scatter grid may be linear or crossed. Bucky furthermore taught a focused anti-scatter grid.

Improvements to the construction of anti-scatter grids have reduced the need to move the grid, thereby simplifying the apparatus and timing between the anti-scatter grid motion and X-ray generator. However, Moiré pattern artifacts can be introduced when films from such apparatus are digitized. Image intensifiers for fluoroscopy can also produce Moiré pattern artifacts. It is known and recommended to align the bars of a linear anti-scatter grid perpendicular to the direction of scan (The Essential Physics of Medical Imaging, Jerrold T Bushberg, J. Anthony Seibert, Edwin M. Leidholdt,Jr., and John M. Boone. c1994 Williams & Wilkins, Baltimore, pg. 162 ff.).

When the X-ray detection panel is composed of a two dimensional array of picture elements or X-ray sensors, as opposed to film or raster scanned screens, the beat between the spatial frequency of the sensitive areas and that of the anti-scatter grid gives rise to an interference pattern having a low spatial frequency, i.e. a Moiré pattern. U.S. Pat. No. 5,666,395 issued to Tsukamoto et al. teaches Moiré pattern prevention with a static linear grid having a grid pitch that is an integer fraction of the sensitive area pitch.

Two cases are discussed in the aforementioned patent. In the first, the sensors are positioned in the array so that there is no dead space between sensor elements. In this instance, the grid pitch is made equal to an integer fraction of the sensor pitch, the distance between adjacent sensor centers. In the second case, the sensors are separated by dead spaces, i.e. interstitial spaces which are insensitive to radiation detection. In this case, the grid pitch is made to correspond to the sensor pitch and is held in a steady position relative to the detection panel such that the grid elements are substantially centered over the interstitial spaces.

One difficulty with the above mentioned cases is that construction of a radiation detection panel having no interstitial spaces between adjacent sensor elements is technically problematic. When there are interstitial spaces present, maintaining the anti-scatter grid in a fixed position relative to the radiation sensor array is often impractical.

There is thus still a need for a grid that will shield from incident scattered radiation an X-ray radiation sensor array comprised of discreet non contiguous elements separated by non-radiation sensitive interstitial spaces that does not require accurate fixed positioning relative to the radiation detection panel, or, in the alternative, does not require moving the grid during exposure to avoid creating Moiré patterns. There is a need for a grid that avoids creating Moiré patterns despite mismatch between the grid and the detection panel.

SUMMARY OF THE INVENTION

According to this invention there is provided a scattered radiation shielding grid comprising a plurality of tiles, each tile being a replicate of a prototile, each prototile comprising a radiation absorbing material arranged in a motif, the motif of radiation absorbing material comprising a plurality of non-overlapping linear segments of radiation absorbing material, wherein the linear segments have equal lengths. The motif may be a pinwheel motif.

Each prototile comprises a width W(p) and a length. The motif is contained solely within the prototile. The prototile width $W(p)=W/(I\pm M\bullet I)$ and $W(p)\neq W+D$. W is the radiation sensitive area width of a radiation detection panel comprising a plurality of equal size radiation sensors separated by interstitial spaces having a width D, over which the grid is positioned, I is an integer and M is a non-integer.

Furthermore, the invention provides a scattered radiation shielding grid comprising a radiation absorbing material, and a radiation detection panel over which the grid is positioned. The radiation detection panel comprises a plurality of equal size radiation sensors having a radiation sensitive area width W, separated by radiation insensitive interstitial spaces having a width D. The grid radiation absorbing material forms a pattern through a combination of a plurality of substantially identical tiles, each tile being a replicate of a prototile. Each prototile in turn comprises: a width $W(p)=W/I$, wherein I is an integer; a length; and a pinwheel motif of the radiation absorbing material contained solely within the prototile.

Further provided by the present invention is a method for designing a pattern for absorption material for a scattered radiation shielding grid for a radiation detection panel comprising an array of a plurality of sensors each having a radiation sensitive area having a width W and a length, wherein the sensors are arrayed so that each radiation sensitive area is separated by each adjacent radiation sensitive area by an interstitial space having a width D. This method comprises:

a) determining a sensor width W corresponding to the width of the radiation sensitive area of the sensor;

b) creating a prototile having a width $W(p)=W/I$ wherein I is an integer;

c) producing within the prototile a pinwheel motif of the radiation absorbing material; and d) tiling a plurality of tiles, each being a replicate of the prototile to produce the pattern, the pattern comprising a combination of the pinwheel motif of the tiled tiles.

Also provided is a method for designing a scattered radiation shielding grid comprising a pattern of radiation absorbing material for a radiation detection panel comprising an array of a plurality of sensors each having a radiation sensitive area having a width W and a length, wherein the sensors are arrayed so that each radiation sensitive area is separated by each adjacent radiation sensitive area by an interstitial space having a width D, the method comprising:

a) determining a sensor width W corresponding to the width of the radiation sensitive area of the sensor;

b) creating a prototile having a width $W(p)=W/(I\pm0.10I)$, $W(p)\neq W+D$ and wherein I is an integer;

C) producing within the prototile a pinwheel motif of radiation absorbing material; and d) tiling a plurality of tiles, each being a replicate of the prototile to produce a pattern comprising a combination of the pinwheel motifs of the tiled tiles.

In another embodiment there is provided a method for generating a radiogram with an exposure system comprising radiation source, and a radiation detection panel. The radiation detection panel comprises an array of a plurality of sensors each having a radiation sensitive area having a width W and a length. The sensors are arrayed so that each radiation sensitive area is separated by each adjacent radiation sensitive area by an interstitial space having a width D. The method comprises positioning between the radiation source and the panel a grid comprising a radiation absorbing material formed in a pattern comprising a combination of a plurality of substantially identical tiled tiles, each tile being a replicate of a prototile, each prototile comprising a width W(p), a length and a pinwheel motif of the radiation absorbing material, the pinwheel motif contained solely within the prototile, wherein the prototile width $W(p)=W/I$ where I is an integer.

BRIEF DESCRIPTION OF THE DRAWINGS

The invention can be more fully understood from the following description thereof, in connection with the accompanying drawings described as follows.

FIG. 10 shows in schematic representation a system for obtaining a radiogram of a target, comprising a radiation source, a radiation detection panel, and a grid placed at a fixed distance between the source and the radiation detection panel.

FIG. 11 shows an anti-scatter grid placed over a detection panel, the grid designed using a prototile according to one embodiment of this invention.

FIG. 11A shows the prototile used to create the grid of FIG. 11.

DETAILED DESCRIPTION OF THE INVENTION

Figure 1:
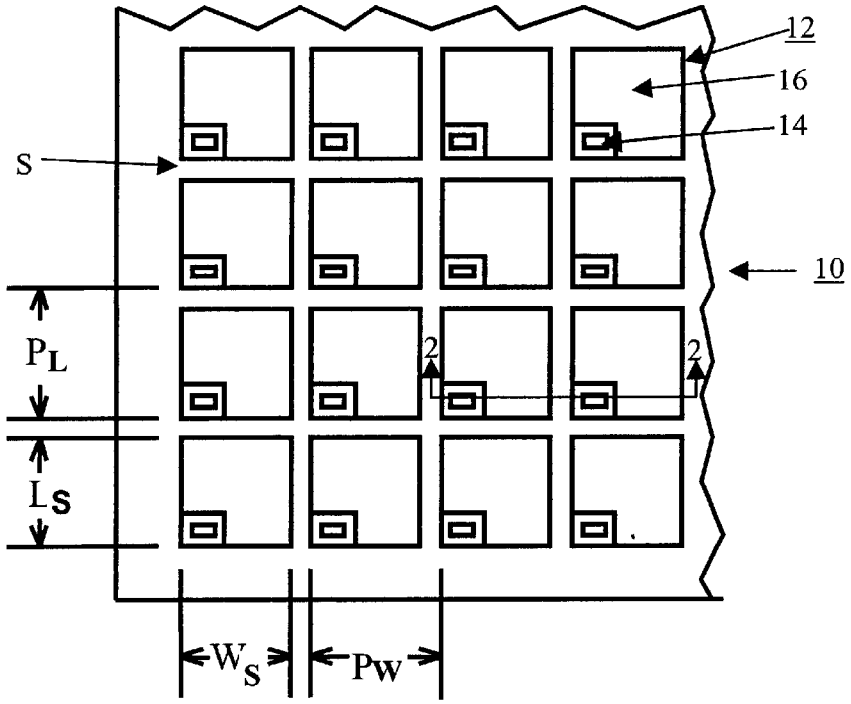
FIG. 1 Prior Art
FIG. 1 shows a schematic of a portion of a typical radiation detection panel comprising an array of radiation detection sensors.

Throughout the following detailed description, similar reference characters refer to similar elements in all figures of the drawings. Tiling, in the present context, means the assembly of a plurality of tiles, each a replicate of the prototile by arraying the tiles contiguously side by side to form a large area comprising a plurality of tiles. As explained in "A series of books in the mathematical sciences" edited by Victor Klee, Copyright 1987, page 20, basic notions, paragraph 1.2 "Tilings with tiles of a few shapes", monohedral tiling is the process of assembling a plurality of same size and shape tiles. Each of these tiles is replicated from a prototile. In the present description, when we refer to tiling we imply monohedral tiling, and when we refer to "prototile," consistent with accepted terminology, we refer to an individual tile of a group of same size and shape tiles. Such prototiles may be virtual, that is exist only as a mathematical expression or may take physical form such as a displayed soft or hard image. When the prototiles contain a design within the prototile, referred to herein as a "motif" the combined motifs of all the tiled prototiles forms a pattern.

There are an infinite number of related prototiles that can be used to generate a particular grid. Any repeating unit of a grid can be said to be generated from a prototile of that repeat pattern. The prototile outline can be translated in the X or Y directions to select an equivalent prototile. Ordinarily, the motif exhibiting the greatest symmetry is preferred, however this is not required. Preference for the highest symmetry motif originates in that the relationship between the motif structure and function is more easily apparent visually.

Referring now to FIG. 1, there is shown a portion of a radiation detection panel 10 useful for radiographic imaging applications.

The portion of a panel 10 comprises a plurality of sensors 12 arrayed in a regular pattern. Each sensor comprises a switching transistor 14 and a radiation detection electrode 16, which defines the sensor radiation detection area. Each radiation detection area has a width "Ws" and a length "Ls," and is separated from an adjacent radiation detection area by an interstitial space "S." The interstitial spaces are substantially incapable of detecting incident radiation. Associated with the sensors, there is also a sensor pitch along the sensor length, "PL" and a sensor pitch along the sensor width,"Pw".

Figure 2:
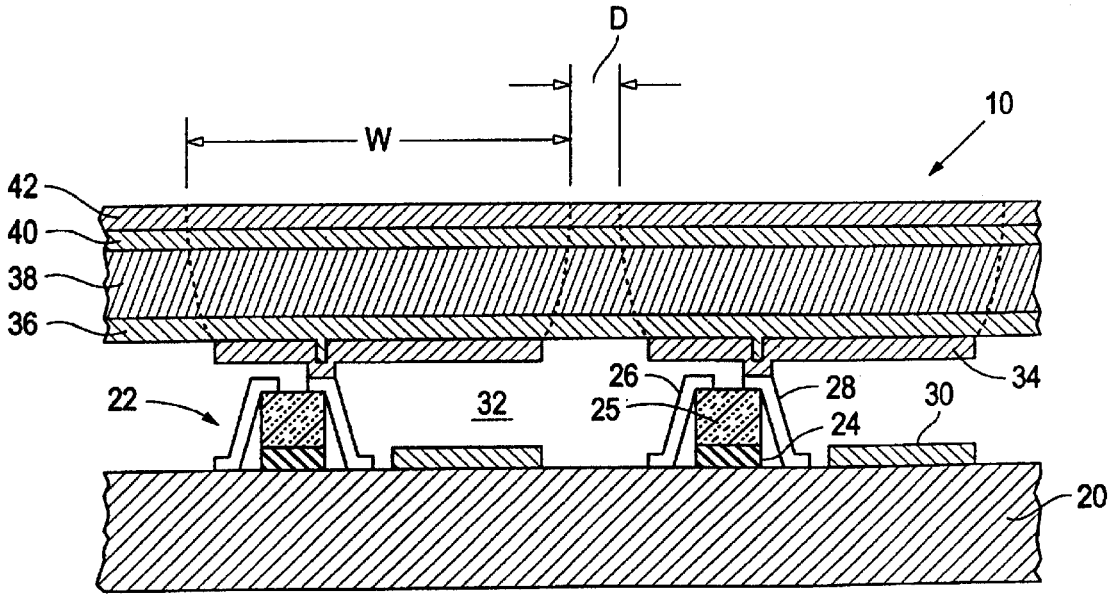
FIG. 2 Prior Art
FIG. 2 shows a cross section of the panel of FIG. 1 along line 2—2, showing in schematic elevation two such array sensors.

FIG. 2 shows a schematic section elevation of a smaller portion of the panel 10 viewed along arrows 2—2 in FIG. 1. The sensor used for illustrating this invention is of the type described in U.S. Pat. No. 5,319,206 issued to Lee et al. and assigned to the assignee of this application, and in U.S. Pat. No. 6,025,599 issued to Lee et al., also assigned to the assignee of this application.

A sensor of this type comprises a dielectric supporting base 20. On this base 20 there is constructed a switching transistor 22, usually a FET built using thin film technology. The FET includes a semiconductor material 25, a gate 24, a source 26 and a drain 28. Adjacent the FET there is built a first electrode 30. A dielectric layer 32 is placed over the FET and the first electrode 30. A collector electrode 34 is next placed over the first electrode 30 and the FET 22. Over the collector electrode there is placed an barrier or insulating layer 36 and over the insulating layer 36 a radiation detection layer 38 which is preferably a layer of amorphous selenium. A second dielectric layer 40 is deposited over the radiation detection layer, and a top electrode 42 is deposited over the top dielectric layer.

The barrier or insulating layer 36, the radiation detection layer 38, the second dielectric layer 40 and the top electrode layer 42 are continuous layers extending over all the FETs and collector electrodes.

In operation, a static field is applied to the sensors by the application of a DC voltage between the top electrode and the first electrodes. Upon exposure to X-ray radiation, electrons and holes are created in the radiation detection layer which travel under the influence of the static field toward the top electrode and the collector electrodes. Each collector electrode collects charges from the area directly above it, as well as some fringe charges outside the direct electrode area. There is thus an effective radiation sensitive area "W" associated with this type of sensor which is somewhat larger that the physical area of the collector electrode. The sensitive areas are separated by a dead space D. In the case where the effective sensitive area is equal to the electrode area, D becomes the interstitial S space.

In an embodiment where the radiation detection layer is columnized, that is where the radiation detection layer extends upward from the collector electrode in an isolated column, the radiation sensitive area will be the same as the physical area of the collector electrode. This is particularly true in the type of sensor that employs a photodiode together with a radiation conversion phosphor layer. In such cases the phosphor layer is usually structured as discreet columns rising above the photodiode.

In describing this invention we will use the term "radiation sensitive area" to designate the actual area which is radiation sensitive, whether it is the same as the physical area of the sensor or not, and the term "opaque" will designate radiation absorption material. In addition, because in practical use an anti-scatter grid is (a) three dimensional and (b) occasionally positioned spaced away from the surface of the radiation detection layer, the terms prototile width and prototile length refer to the width and length of a prototile such that its projected image on the sensitive surface satisfies the required relationships between prototile dimensions and sensitive surface dimensions, when the prototile is in the grid plane. For design purposes, this can be any plane through the grid, parallel to the width and length of the grid. Preferably, this plane is the plane closest to the sensitive surface. Finally, while the grid is usually described as having a height perpendicular to its width and length, it is to be understood that this height can also be inclined with respect to the perpendicular to produce a grid having opaque elements aligned with the incident radiation path which may be a path that diverges radially from the radiation source. This type of grid element orientation is also well known in the art and grids having such inclined walls are described in U.S. Pat. No. 4,951,305 issued to Moore et al. (Particularly Moore, FIG. 8). Grids having such oriented elements are still to considered as being included when there is reference to a grid height.

In practice, particularly where the grid is placed in contact with, or close to the sensitive surface, the projected and actual dimensions will be substantially the same, in which case the actual dimensions will be convenient to use. The relationship between the projected grid and the sensitive area is described herein in terms of percent mismatch between the elements of the grid and the corresponding elements of the sensor.

Figure 3A:
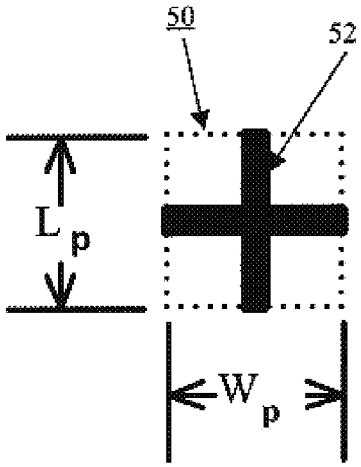
FIG. 3A shows a cross prototile used in the grid of FIG. 3.
Figure 3:
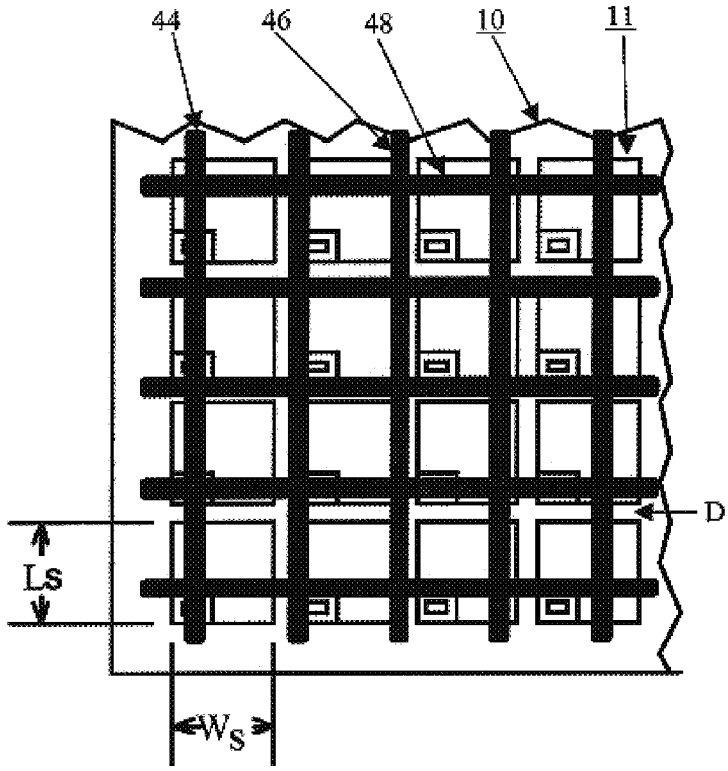
FIG. 3 shows a schematic of an anti-scatter grid placed over a detection panel, the grid mismatched with the panel.

FIG. 3 shows a portion of a radiation detection panel of the type described above with a portion of a scattered radiation shielding grid 44 placed over the panel. As shown in the figure, the grid comprises a pattern of a plurality of opaque strips 46 and 48 aligned along the width and length of the panel.

This type of anti-scatter grid, is a common type of anti-scatter grid available, and may be manufactured easily. See for instance U.S. Pat. No. 5,606,589 issued to Pellegrino et al., which discloses such a cross grid and a method for its manufacture and use in medical radiography.

However, use of this type of grid with a radiation detection panel of the type disclosed above is prone to the production of Moiré patterns, unless as taught by Tsukamoto et al. in U.S. Pat. No. 5,666,395, the grid is fixed in relationship to the underlying array of radiation sensors, the grid pitch is the same as the array pitch, and the grid bars are aligned with the centerlines of the interstitial spaces. Such a relationship requires zero percent mismatch between the detection panel and the grid.

The present invention employs a grid having a pattern of absorbing material that does not produce Moiré patterns without requiring the exact placement of the grids of the prior art. As clearly shown in FIG. 3, the absorbing material pattern of grid 44 is not aligned with the interstitial or dead spaces of the underlying array of sensitive areas 11. Unlike the Tsukamoto grid, grid 44 may be placed anywhere and still function effectively, within the limits of alignment to the radial radiation. Further more the grid may be moved during the radiation exposure.

Each of the tiles tiled to form the grid are replicates of a prototile that includes a motif 52 which will be used to design the opaque pattern of the grid. In FIG. 3A this motif is a cross. The motif of the prototile is selected such that when the tiles are tiled, the pattern of the plurality of the tiled tiles combined form the grid pattern shown in FIG. 3. As better shown in FIG. 3A, the prototile 50 has a width Wp and a length Lp. The width of the prototile Wp equals the width Ws of the radiation sensitive area 11 of the sensor of the panel divided by an integer I. Thus Wp=Ws/I. In most instances I=1. The same is applicable to the length Lp of the prototile relative to the length Ls of the sensitive area; again Lp=Ls/B, where B is an integer, and again, preferably B=1.

Referring now to FIG. 11, grid 94 has been designed in accordance with this invention by tiling a plurality of tiles, replicated from prototile 90, shown in dotted lines in FIG. 11 to generate the pattern for the absorbing material. The radiation absorbing material in the figures are shown as thick black segments. The prototile 90 and the grid 94 are not shown to scale in the figures. The prototile is enlarged relative to the grid to provide detail.

As better shown in FIG. 11A, the prototile 90 also has a width Wp and a length Lp. The width of the prototile Wp equals the width Ws of the radiation sensitive area 11 of the sensor of the panel divided by an integer I. Thus Wp=Ws/I. In most instances I=1. The same is applicable to the length Lp of the prototile relative to the length Ls of the sensitive area; again Lp=Ls/B, where B is an integer, and again, preferably B=1.

The prototile includes a motif 92 which represents radiation absorbing material. In FIG. 11A this motif is a "pinwheel." The motif is selected such that when the tiles derived from the prototile 90 are tiled, the motifs of the plurality of the tiles combine upon tiling of the tiles to form the pattern shown in FIG. 11. This is the pattern for the opaque material in the grid.

Figure 4A:
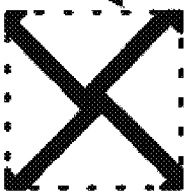
FIG. 4A shows a pinwheel prototile according to the present invention.
Figure 7A:
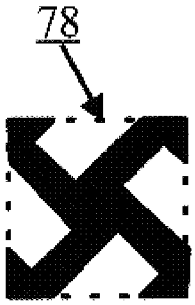
FIG. 7A shows another pinwheel prototile according to the present invention.

The pinwheel motif shown in the protiles 69, 78 of FIGS. 4A and 7A respectively is a preferred motif. Unlike the cross motif shown in FIG. 3A and the diamond motif shown in a comparative example in FIG. 8A, the pinwheel motif has no "crossover region" at the center of the motif. The crossover region of the cross motif is the location where the two diagonal linear segments of the cross overlay, such as the lines of an "X". Since the linear segments overlap in the crossover region, even if only conceptually, the area of radiation absorbing material, along the width or length of the tile is less at the cross-region than at any other position. A pinwheel motif avoids any such crossover region in the tile.

The elimination of the crossover region achieved by the pinwheel motif, eliminates a Moiré "hot spot" caused by the reduced area of radiation absorbing material in the crossover region. By eliminating the crossover region, the modulation and overall perception of the Moiré pattern is reduced. An exemplary reduction in Moiré pattern perception is shown in comparing the resulting Moiré patterns in FIGS. 4C and 8C. The pinwheel motif 69 of FIG. 4A forms the patterned grid 71 shown in FIG. 4B when assembled into a grid. This grid 71 produces the Moiré pattern 73 shown in FIG. 4C. In FIGS. 4A, B, and C; 7A, B, and C; and 8A, B, and C the prototiles, grids and resulting Moiré patterns are not shown to scale. The prototile is enlarged relative to the grid, and the grid is enlarged relative to the corresponding Moiré pattern to better illustrate the features of interest.

Figure 4B:
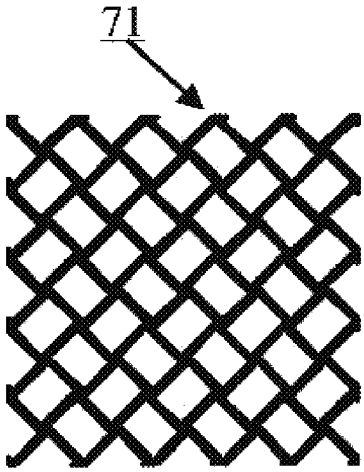
FIG. 4B shows a grid from the assembly of a plurality of tiles replicated from the prototile shown in FIG. 4A.
Figure 4C:
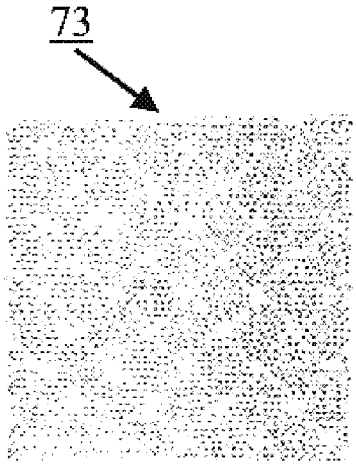
FIG. 4C shows a Moiré pattern resulting from the grid shown in FIG. 4B when mismatched 5% with a radiation detection panel.
Figures 8A, 8B, 8C:
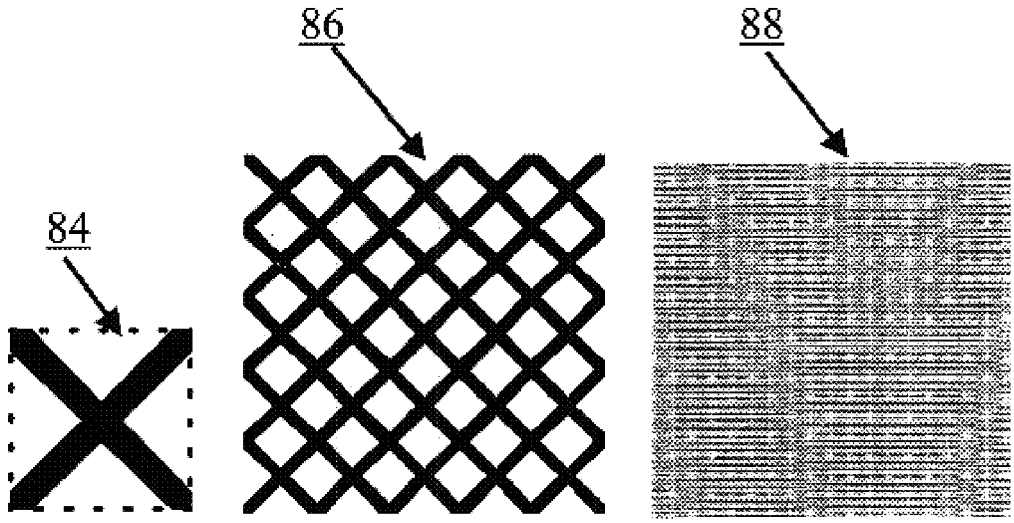
FIG. 8A shows a diamond prototile as a comparative example.
FIG. 8B shows a grid from the assembly of a plurality of tiles replicated from the prototile shown in FIG. 8A.
FIG. 8C shows a Moiré pattern resulting from the grid shown in FIG. 8B when slightly mismatched with a radiation detection panel.

In computer simulations, this grid 71 of FIG. 4B produced a Moiré pattern modulation of 1.0%, whereas a grid 86 (FIG. 8B) assembled from the diamond motif 84 of FIG. 8A produced a Moiré pattern 88, shown in FIG. 8C, with a modulation of 11.2% in simulations. Moiré pattern modulation is the difference between the highest amplitude and lowest amplitude areas of the pattern, divided by the highest amplitude of the overall Moiré pattern, multiplied by 100. The modulation percentage of the Moiré pattern is an indication of the perception of the Moiré pattern as the greater the differences between the high and low amplitude regions, the greater the perception of the Moiré pattern.

Figure 7B:
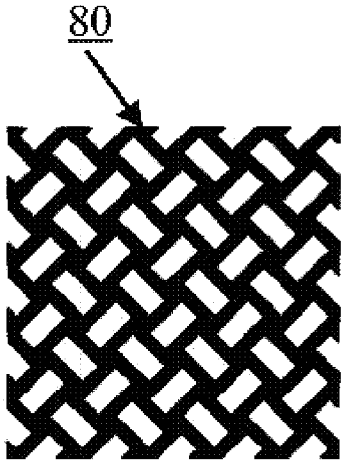
FIG. 7B shows a grid from the assembly of a plurality of tiles replicated from the prototile shown in FIG. 7A.
Figure 7C:
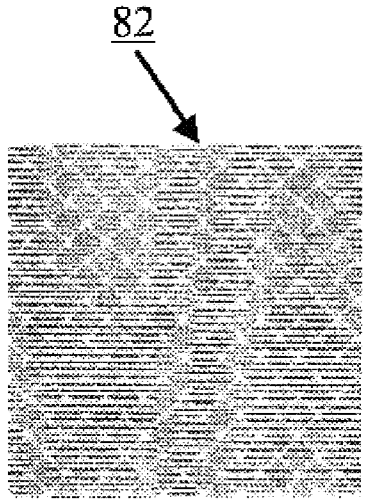
FIG. 7C shows a Moiré pattern resulting from the grid shown in FIG. 7B when slightly mismatched with a radiation detection panel.

Similar to FIGS. 4A, B and C, FIG. 7B shows a grid 80 assembled from of a plurality of tiles replicated from the prototile 78 shown in FIG. 7A. The radiation absorbing material of prototile 78 occupies a higher percentage of the prototile area than does the radiation absorbing area of prototile 69. FIG. 7C shows a Moiré pattern 82 resulting from the grid shown in FIG. 7B when mismatched 5% with a radiation detection panel.

Figure 5:
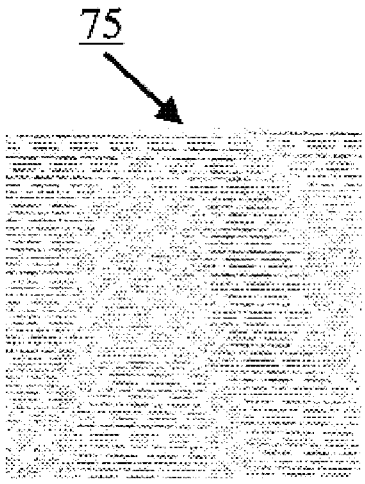
FIG. 5 shows a Moiré pattern resulting from the grid shown in FIG. 4B when mismatched with a radiation detection panel by 10%.
Figure 6:
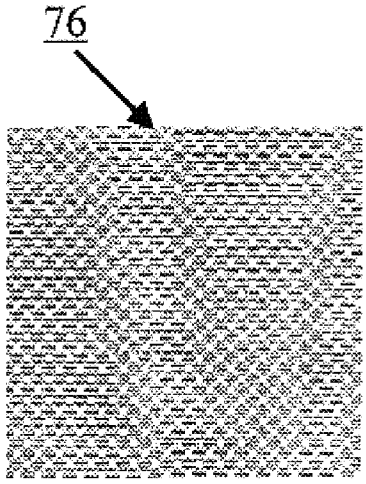
FIG. 6 shows a Moiré pattern resulting from the grid shown in FIG. 4B when mismatched with a radiation detection panel by 20%.

The pinwheel motif is also less sensitive to mismatching between the anti-scatter grid and detection panel than other prototile motifs. As shown in FIGS. 5 and 6, the Moiré pattern modulation resulting from a grid comprising tiles with a pinwheel motif increases modestly with an increase in mismatch between grid and detector elements. The Moiré pattern 75 in FIG. 5 was simulated with a 10% mismatch between the tiles of the grid and the sensors of the detection panel. This arrangement exhibits a modulation of 4.7%, and a radiation transmission value of 70.5% in simulation. The Moiré pattern 76 of FIG. 6 was simulated with a 20% mismatch, and showed a modulation of 10.0%, and a radiation transmission value of 72.1% in simulation.

Figure 9:
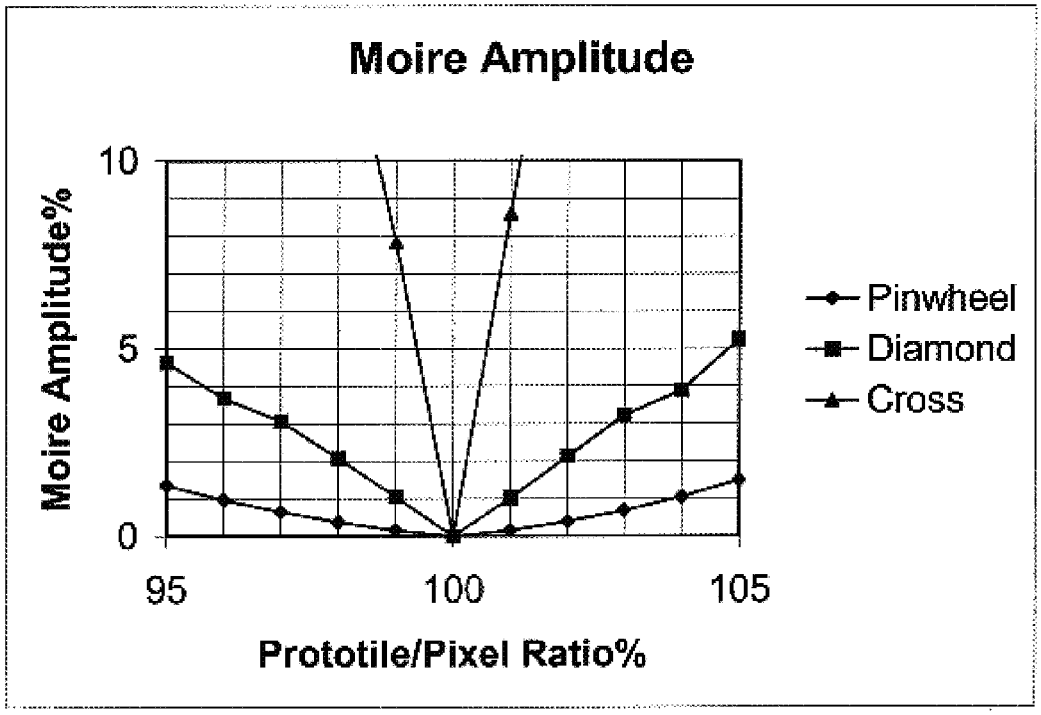
FIG. 9 is a graph of Moiré amplitude vs. grid and array mismatch.

FIG. 9 is a graph showing the calculated Moiré pattern amplitude as a function of percent mismatch between the detection panel and the anti-scatter grid for three prototile motifs: the pinwheel motif according to the present invention FIG. 4A; the cross motif FIG. 3A, as discussed above; and a diamond motif FIG. 8A, shown in U.S. Pat. No. 5,606,589 Pellegrino et al. to ThermoTrex (now held by Hologic). The graph in FIG. 9 shows that the cross motif (triangle symbol) shown in FIG. 3A is highly sensitive to any mismatch between the anti-scatter grid and the detection panel. However, the diamond (square symbol) (FIG. 8A) and the pinwheel (square-on-point symbol) (FIGS. 4A and 7A) motifs are considerably less sensitive, with the pinwheel motif being the least sensitive to mismatch between the anti-scatter grid and the detector panel. The amplitude of the Moiré pattern remains small for a grid using the pinwheel even as the projected size of the elements or tiles of the grid varies. This occurs when the X-ray source to grid or the grid to detector distance varies, for example. Further, manufacturing variances in grid construction will be less detrimental in producing Moiré patterns when the pinwheel motif is used.

A number of different grid designs can be produced using the technology disclosed in U.S. Pat. No. 5,259,016 issued to Dickerson et al. The use of photographic techniques to produce radiation absorption grids having shapes other than straight lines is shown in that reference and can be used to produce grids designed using the present invention wherein the opaque grid strips are other than straight lines. The aforementioned U.S. Pat. No. 4,951,305 issued to Moore et al. also teaches methods for producing complex grid shapes.

Although the above discussion has been limited to the grid design in the x-y plane, it is understood that the grid has a third dimension along the z axis, or in other words the grid walls have a height. The wall height ranges from about 2 to 16 times the thickness of the wall. A preferred height ratio is about 6 to 12. The ratio of wall thickness to the prototype width ranges from about 1/10 to 1/2 with a preferred ratio of about 1/6.

Because the radiation impinges on the panel at different angles rather than perpendicular, i.e. along the z axis, the projection of the grid on the panel will be both magnified and distorted depending on the distance of the grid from the radiation sensitive surface, and to some extent depending on the distance and nature of the radiation source.

A collimated radiation source, for instance, will produce no magnification or distortion effect, while a point source will produce both. These effects are well understood in the art and proper compensation to the grid design will be made, by designing a grid using a prototile such that its projection on the panel will satisfy the above developed criteria. These effects are minimized by placing the grid in close proximity and preferably intimate contact with the sensitive area, and by minimizing the grid wall height.

In summary, a grid is designed as follows in accordance with this invention. First, the effective radiation detection area of the panel sensors is determined to identify the radiation sensitive area and the prototile size is then determined according to the relationships given above. Next, a desired motif is created in the prototile. The prototile is then duplicated and a plurality of tiles assembled to create the pattern of the grid which results from the combined motifs of the tiles. Mirror images of the prototile may also be used with the original prototile to create a pattern. This pattern is then used for the radiation absorption material which forms the anti-scatter grid. This material may be lead. The grid may be constructed according to the teachings of the aforementioned U.S. patents to Dickerson et al., Pellegrino et al. or Moore et al. If the grid is not to be in contact with the sensors and the radiation source is a point source, the prototile design is based on the projection of the grid onto the sensitive area, as discussed above.

As may be surmised by the above discussion, it is very difficult to obtain grids with the exact requisite absorbing material spacing and thickness completely free from manufacturing imperfections. Furthermore, thermal expansion may alter somewhat the grid element spacing, and a shift during installation may change the originally calculated distance between the grid elements and the detection panel so that the relationship $W(p)=W/I$ no longer holds absolutely true. Surprisingly, it has been observed that some deviation of the theoretically optimum grid pattern for a particular detection panel and grid positioning is acceptable when the detection panel includes, as is almost always the case, an associated gain control circuit.

Gain control circuits are used to compensate for different output levels of different individual sensors in an array of such sensors by correcting the individual output of each sensor or pixel such that when a detection panel is illuminated by uniform intensity radiation, the output of each sensor becomes the same. In a typical digital gain correction system, this involves a calibration step whereby prior to using a detection panel in an image detection system, the panel is exposed to radiation at a predetermined level of intensity. Each of the individual sensors output is recorded and for each individual sensor there is generated and stored a correction factor usually in a Look-Up-Table (LUT). When an image is obtained the raw output of each sensor is corrected by the corresponding correction factor from the LUT.

According to this invention, if the calibration step is undertaken with the grid in place, whereby instead of a substantially uniform illumination level the grid image is projected on the panel variations in the grid absorbing material pattern of as much as + or −10% from the calculated dimensions are compensated for by the gain correction system. Thus a manufactured grid whose pattern corresponds to a prototile width $W(p)=W/(I\pm0.11)$ and $W(p)$ different ($\neq$) from $W+D$ still results in a grid that presents no objectionable Moiré patterns.

FIG. 10 illustrates the use of this grid in a system to obtain a radiogram. The system includes a radiation source 60, which is typically an X-ray source emitting a beam of radiation 62. A target or patient 64 is placed in the beam path. On the other side of the patient there is placed a combination of a grid 66 and detection panel 68. The grid is a grid created in accordance with the present invention and has a pattern of absorbing material, such as, for instance, shown in FIG. 11 discussed earlier. Behind the grid 66 at a fixed distance therefrom is positioned a radiation detection panel 68 such as the panel described earlier in conjunction with FIGS. 1 and 2. The panel is connected over wire 70 to a control console 72 which may include a display screen 74 and/or a hard copy output device (not shown) for producing a hard copy of the radiogram. Typically the control console will also include a plurality of image processing circuits, all of which are well known in the art. Preferably, a gain control circuit is included, either as a part of the detection panel itself or as part of the control console.

Preferably, the grid was originally designed such that $W(p)=W/I$. However even if due to manufacturing imperfections, thermal change, actual spacing between the installed grid and detection panel or whatever other reason such relationship is not satisfied exactly, as long as the actual grid pattern satisfies the relationship $W(p)=W/(I\pm0.10I)$ discussed above, such grid is acceptable.

In obtaining the radiogram, first the system is calibrated by obtaining a blank exposure of the detection panel, that is one without the target present, and using the gain control circuit to generate a flat field output image, i.e. one that has a uniform density throughout the image area. The target is then placed in position and exposed to radiation. The radiation becomes imagewise modulated as it traverses the target and impinges on the detection panel after transiting the grid. The resulting image has been found substantially free of Moiré interference patterns. The same result was obtained whether the grid was stationary during exposure or whether the grid is mounted on a moving support that moves the grid during exposure in a plane substantially parallel to the plane of the detection panel.

Those having the benefit of the above disclosure, which teaches a grid for limiting scattered radiation from impinging on a radiation detection panel having an array of sensitive areas separated by non radiation sensitive interstitial spaces by designing a grid of radiation opaque areas such that regardless of the placement of the grid relative to the sensitive area array the opaque areas always cover the same amount of area of the sensitive area, may modify this invention in numerous ways to achieve this result. These modifications are to be construed as being encompassed within the scope of the present invention as set forth in the appended claims.

I claim:

1. The scattered radiation shielding grid comprising a plurality of tiles, each tile replicated from a prototile comprising a radiation absording material arranged in a motif, the motif of radiation absorbing material comprising a plurality of non-overlapping linear segments of radiation absorbing material, wherein the segments have an equal length;

wherein the prototile comprising a width $W(p)$, a length and the motif solely within the prototile, wherein the prototile width $W(p)=W/(I\pm M\bullet I)$ and $W(p)\neq W+D$, where W is a radiation sensitive area width of a radiation sensor of a radiation detection panel comprising a plurality of equal size radiation sensors separated by interstitial spaces having a width D, over which the grid is positioned, I is an integer and M is a non-integer.

2. The scattered radiation shielding grid of claim 1 wherein M is less than 0.10.

3. The scattered radiation grid according to claim 1 wherein W(p)=W/I.

4. A method for designing a scattered radiation shielding grid comprising a pattern of radiation absorbing material for a radiation detection panel comprising an array of a plurality of sensors each having a radiation sensitive area having a width and a length, the sensors arrayed so that each radiation sensitive area is separated by each adjacent radiation sensitive area by an interstitial space having a width D, the method comprising:

a) determining a sensor width W corresponding to the width of the radiation sensitive area of the sensor;

b) creating a prototile having a width W(p)=W/(I±0.10I), W(p)≠W+D and wherein I is an integer;

c) producing within the prototile a pinwheel motif of radiation absorbing material; and d) tiling a plurality of tiles replicated from said prototile to produce a pattern comprising a combination of the pinwheel motifs of the tiled tiles.

5. The method according to claim 4 wherein in step (b) the prototile width W(p)=W/I.

6. A method for generating a radiogram with an exposure system comprising radiation source, and a radiation detection panel, wherein said radiation detection panel comprises an array of a plurality of sensors each having a radiation sensitive area having a width W and a length, the sensors arrayed so that each radiation sensitive area is separated by each adjacent radiation sensitive area by an interstitial space having a width D, the method comprising:

positioning between the radiation source and the panel a grid comprising a radiation absorbing material formed in a pattern comprising a combination of a plurality of substantially identical tiled tiles replicated from a prototile, said prototile comprising a width W(p), a length and a pinwheel motif of the radiation absorbing material, the pinwheel motif contained solely within the prototile, wherein the prototile width W(p)=W/I where I is an integer.

7. A scattered radiation shielding grid comprising a radiation absorbing material, and a radiation detection panel over which said grid is positioned comprising a plurality of equal size radiation sensors having a radiation sensitive area width W, separated by radiation insensitive interstitial spaces having a width D, and wherein said grid radiation absorbing material forms a pattern, the pattern comprising a combination of a plurality of substantially identical tiles, each tile replicated from a prototile comprising:

(a) a width W(p)=W/I, wherein I is an integer;

(b) a length; and (c) a pinwheel motif of the radiation absorbing material contained solely within the prototile.

8. The scattered radiation grid and detection panel according to claim 7 further comprising a pixel gain correction circuit associated with said further detection panel and wherein W(p)=W/(I ±0.10I) and W(p)≠W+D.

9. The scattered radiation grid and detection panel according to claim 8 further comprising a radiation source, wherein said grid is positioned between said panel and said radiation source at a fixed, known distance from said panel, wherein said prototile width W(p) is a projected prototile width on said panel.

10. A method for designing a pattern for absorption material for a scattered radiation shielding grid for a radiation detection panel comprising an array of a plurality of sensors each having a radiation sensitive area having a width W and a length, the sensors arrayed so that each radiation sensitive area is separated by each adjacent radiation sensitive area by an interstitial space having a width D, the method comprising:

a) determining the width of the radiation sensitive area W of the sensor;

b) creating a prototile having a width W(p)=W/I wherein I is an integer;

c) producing within the prototile a pinwheel motif of the radiation absorbing material; and d) tiling a plurality of tiles replicated from the prototile to produce the pattern, the pattern comprising a combination of the pinwheel motifs of the tiled tiles.

* * * * *